US008390802B2

(12) United States Patent
Frey, Jr. et al.

(10) Patent No.: US 8,390,802 B2
(45) Date of Patent: Mar. 5, 2013

(54) DISTRIBUTED ARRAY SEMI-ACTIVE LASER DESIGNATOR SENSOR

(75) Inventors: Robert D Frey, Jr., Bolton, MA (US); Stephen F Sagan, Lexington, MA (US)

(73) Assignee: BAE Systems Information and Electronic Systems Intergration Inc., Nashua, NH (US)

( * ) Notice: Subject to any disclaimer, the term of this patent is extended or adjusted under 35 U.S.C. 154(b) by 652 days.

(21) Appl. No.: 12/465,033

(22) Filed: May 13, 2009

(65) Prior Publication Data

US 2010/0290038 A1 Nov. 18, 2010

(51) Int. Cl.
*G01B 11/26* (2006.01)

(52) U.S. Cl. ..... 356/152.1

(58) Field of Classification Search ..... 356/152.1; 244/3.1–3.18

See application file for complete search history.

(56) References Cited

U.S. PATENT DOCUMENTS

| | | | | | |
|---|---|---|---|---|---|
| 3,398,918 | A * | 8/1968 | Girault | 244/3.13 |
| 3,782,667 | A * | 1/1974 | Miller et al. | 244/3.13 |
| 3,932,039 | A * | 1/1976 | Frey | 356/138 |
| 4,193,689 | A * | 3/1980 | Reymond et al. | 356/139.03 |
| 4,383,663 | A * | 5/1983 | Nichols | 244/3.16 |
| 4,558,836 | A * | 12/1985 | Kriegesmann | 244/3.11 |
| 5,039,217 | A * | 8/1991 | Maekawa et al. | 356/3.01 |
| 5,321,718 | A * | 6/1994 | Waarts et al. | 372/108 |
| 5,483,333 | A * | 1/1996 | Dancer | 356/152.1 |
| 5,523,193 | A * | 6/1996 | Nelson | 430/311 |
| 5,664,741 | A * | 9/1997 | Duke | 244/3.11 |
| 5,784,156 | A * | 7/1998 | Nicholson | 356/141.5 |
| 5,788,178 | A * | 8/1998 | Barrett, Jr. | 244/3.11 |
| 5,796,474 | A * | 8/1998 | Squire et al. | 356/152.1 |
| 5,969,676 | A * | 10/1999 | Tran et al. | 342/442 |
| 6,069,692 | A * | 5/2000 | Stoffberg | 356/152.1 |
| 6,262,800 | B1 * | 7/2001 | Minor | 356/139.07 |
| 6,480,271 | B1 * | 11/2002 | Cloud et al. | 356/152.1 |
| 6,665,111 | B2 * | 12/2003 | Sundaram | 359/299 |
| 6,943,873 | B2 * | 9/2005 | Sallee | 356/141.1 |
| 7,372,425 | B2 * | 5/2008 | Cortambert | 343/824 |
| 7,714,989 | B1 * | 5/2010 | Freeman et al. | 356/4.01 |
| 2003/0102403 | A1 * | 6/2003 | Jones et al. | 244/3.13 |
| 2005/0258348 | A1 * | 11/2005 | English et al. | 250/225 |
| 2006/0287829 | A1 * | 12/2006 | Pashko-Paschenko | 701/301 |
| 2008/0087761 | A1 * | 4/2008 | Jenkins et al. | 244/3.16 |
| 2009/0115654 | A1 * | 5/2009 | Lo et al. | 342/62 |

OTHER PUBLICATIONS

Guoyu Li, Tuan Guo,Fiber Grating Sensing Interrogation Based on an InGaAs Photodiode Linear Array,Applied Optics / vol. 46, No. 3, Jan. 20, 2007.*

T.P.Vogl A.K.Rigler, Asymmetric Lens Design Using Bicubic Splines: Application to the Color TV Lighthouse,Applied Optics, vol. 10, No. 11, Nov. 1971.*

S. Bourquin, V. Monterosso, Video-rate Optical Low-Coherence Reflectrometry Based on a Linear Smart Detector Array, Opticas Letters, vol. 25, No. 2, Jan. 15, 2000.*

Kindratenko, V., Calibration of Electromagnetic Tracking Devices, Virtual Reality, vol. 4, pp. 139-150, 1999.*

Vogl, T.P, Aysmmetric Lens Design Using Bicubic Splines: Application to the Color TV lighthouse, Applied Optics, vol. 10, No. 11, Nov. 1971.*

Li, Guoyu, Guo, Tuan, Fiber Grating Sensing Interrogation based on an InGaAs Photodiode Linear Array, Applied Optics, vol. 46, No. 3, Jan. 2007.*

* cited by examiner

*Primary Examiner* — Luke Ratcliffe
*Assistant Examiner* — Antoine J Bedard
(74) *Attorney, Agent, or Firm* — Maine Cernota & Rardin; Andrew P. Cernota

(57) ABSTRACT

A system is provided for semi-active laser designation, the system comprising: a guidance and control system having a plurality of wings disposed at an aerodynamically advantageous angle; a plurality of linear sensor arrays configured to measure location of a target, each the sensor array being disposed on a wing of the plurality of wings; and each the linear sensor array providing independent data to the guidance and control system as to the location of the target.

19 Claims, 8 Drawing Sheets

DISTRIBUTED ARRAY SEMI-ACTIVE LASER DESIGNATOR SENSOR

FIELD OF THE INVENTION

The invention relates to distributed aperture semi-active laser seeker, and more particularly, to such a seeker having a linear array directly mounted to optics.

BACKGROUND OF THE INVENTION

Known distributed array semi-active laser designator sensors utilize four collection apertures disposed on mid-wing locations. Designator return energy collected at each aperture is transmitted via fiber optic cable to an optical system that combines signal collected by the individual apertures and in order to illuminate an array of avalanche photodiodes. The illumination collected from the four apertures are used to reconstruct the angle to target relative to the body coordinate system.

Angle reconstruction assumes that the four optical systems are aligned and maintain alignment throughout flight. Misalignment is accounted for in the laboratory calibration of the sensors. Any subsequent variation in the alignment will introduce error into the reconstruction and degrade system performance. The wing structure is driven by this requirement to effectively become an optical bench operating at supersonic speeds. This constrains the aerodynamic design of the system and introduces drag due to additional wing thickness to support the optical system.

What is needed, therefore, are techniques for providing aerodynamically advantageous, low cost, and robust wing mounted capabilities for the sensing of designated targets.

SUMMARY OF THE INVENTION

One embodiment provides a system for semi-active laser designation, the system comprising: a guidance and control system having a plurality of wings disposed at an aerodynamically advantageous angle; a plurality of linear sensor arrays configured to measure location of a target, each the sensor array being disposed on a wing of the plurality of wings; and each the linear sensor array providing independent data to the guidance and control system as to the location of the target.

Another embodiment of the present invention provides such a system wherein the linear sensor array is a InGaAs Pin Diode.

A further embodiment of the present invention provides such a system wherein the linear sensor array has a sensitivity lower than an avalanche photodiode.

Still another embodiment of the present invention provides such a system wherein the linear sensor array has an asymmetrical prescription.

A still further embodiment of the present invention provides such a system further comprising a horizontal field of regard of between 0 and 14 degrees.

Yet another embodiment of the present invention provides such a system further comprising a vertical field of regard of ±14 degrees.

A yet further embodiment of the present invention provides such a system wherein the linear array comprises at least 5 pixels.

Even another embodiment of the present invention provides such a system wherein three of the pixels cover a 14 degree field of regard.

An even further embodiment of the present invention provides such a system further comprising a pixel noise of not greater than 0.28 degrees, root mean squared.

Still yet another embodiment of the present invention provides such a system wherein the wing being disposed with a wing of about approximately 7 degrees.

A still yet further embodiment of the present invention provides such a system wherein the wing is disposed about approximately normal to the body of the system.

A still even further embodiment of the present invention provides such a system further comprising an asymmetric lens.

One embodiment of the present invention provides an method for the determination of angle to target of semi-active laser detection system, that method comprising: locating a target with two linear sensor arrays of a plurality of linear sensor arrays; identifying a quadrant in which the target is disposed; obtaining measurements of angular position of the target with respect to individual sensors within the two linear sensor arrays; using a two dimensional lookup table relating sensed azimuth-elevation to true azimuth elevation.

Another embodiment of the present invention provides such a method wherein the lookup table contains true azimuth data calculated from the dependency of sensed azimuth data error on distance of the target from an axis coincident with the sense axis for an array.

One embodiment provides an apparatus for the detection of a target, the apparatus comprising: a plurality of linear InGaAs sensor arrays; the linear InGaAs arrays being configured with asymmetric lenses; the linear InGaAs arrays each having at least 5 pixels; the linear InGaAs arrays being configured to provide a horizontal field of regard of 0 to 14 degrees; and angular location of the target is provided by mean dos comparison of measured angles from at least two of the InGaAs sensor arrays and a two dimensional lookup table relating sensed azimuth elevation and true azimuth elevation.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
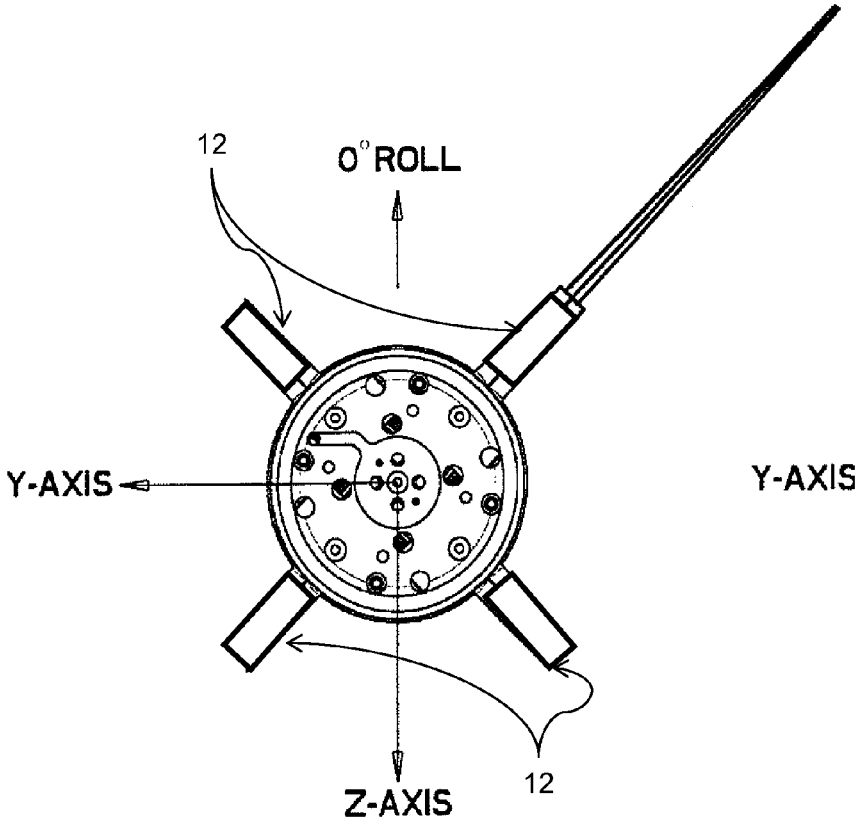
FIG. 1 is a front elevation view illustrating a seeker vehicle having four semi-active laser designator sensors configured in accordance with one embodiment of the present invention.
Figure 2:
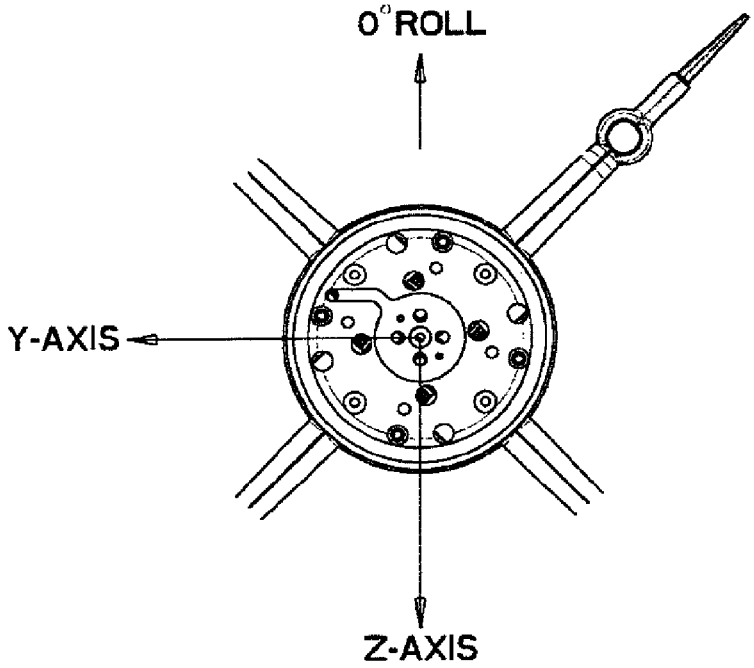
Fig. 2 (Prior Art)
FIG. 2 is a front elevation view illustrating one of four optical collection apertures on a seeker vehicle of a known configuration. This collection aperture is summed with the other three apertures in an array of avalanche photodiodes.
Figure 3:
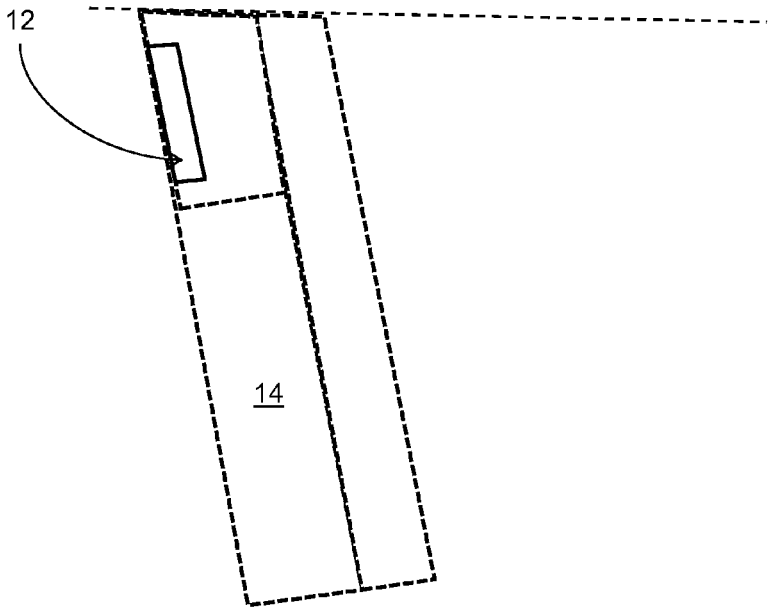
FIG. 3 is a top plan view illustrating a wing of a seeker vehicle having a semi-active laser designator sensor configured in accordance with one embodiment of the present invention.
Figure 4:
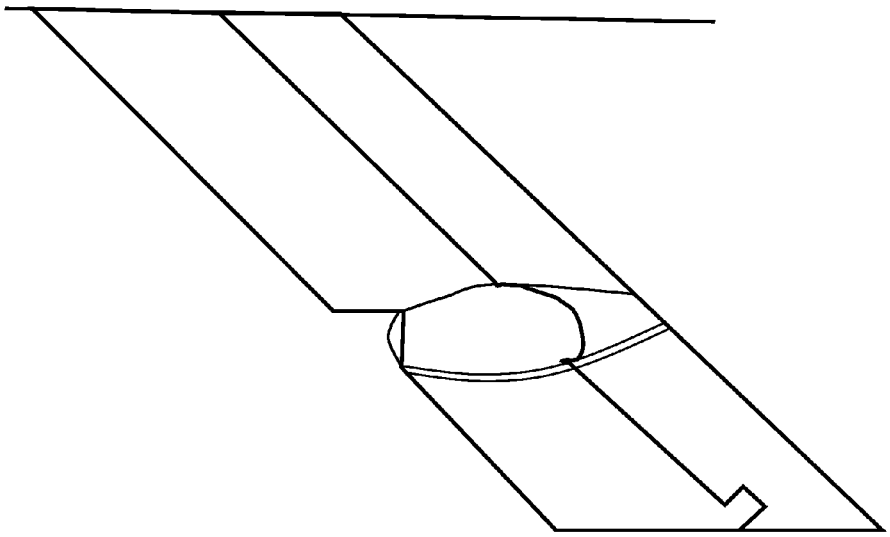
Fig. 4 (Prior Art)
FIG. 4 is a top plan view illustrating a wing of a seeker vehicle having a collection aperture which feeds an avalanche photodiode array of a known configuration.

One embodiment of the present invention provides four linear arrays 12 in the wings. These arrays 12 are designed to measure the target location over an angle of 0 to 14 degrees in the axis of the wing 14. Such an embodiment is illustrated in FIG. 1 and FIG. 3. For purposes of illustration, these are contrasted with known configurations illustrated in FIGS. 2 and 4. The measurements from each sensor are independent of each other in that their signals need not be summed to determine the target location. Such an embodiment eliminates the need to fly an optical bench composed of the wings as alignment is not required among the four sensors. In addition, the measurement of target angle coincident with the wing axis places the measurement on the inherently stiff axis of the wing. Motion in the cross axis will not significantly impact the measurement allowing significant relaxation of wing stiffness requirements.

One embodiment of the present invention uses 4 linear (1-D) arrays of InGaAs PIN diodes 12 mounted in the wings. InGaAs PIN diodes have lower sensitivity but are inherently uniform and are less expensive than avalanche photodiodes used by known systems. Lower cost silicon pin diode arrays can also be utilized dependent given signal return or available aperture area. The loss in sensitivity in using these less expensive and lower sensitivity detectors is compensated by increasing the aperture of the sensor as well as eliminating the 91% signal loss of known fiber optics.

The sensors are designed to collect energy return from a laser designator illuminating a target. Location of the target is determined from the position of light focused on a sensing array. In order to determine the position to subpixel levels, the "image" of the designator return is purposely defocused to cover multiple pixels. The defocused distribution of the light on the array allows sensing of target location at resolutions far greater than the inherent resolution determined from the spacing of the pixels.

The subpixel location of the target can be determined in two dimensions with a two dimensional array. A two dimensional array, however, requires an optical system with a circular aperture, an inconvenient form factor when mounted in a wing. This invention describes an alternative method that measures the two dimensional position of the target using 1-dimensional arrays more appropriate for mounting in the leading edge of a wing. As with the two dimensional array, the relative amplitude of the designator return across the pixels in the array determines the location. The one-dimensional array is constrained to a single dimension of measurement requiring a minimum of two sensors to uniquely measure a target location in two dimensions.

The defocus of the optical system is critical to subpixel measurement accuracy. Systems that rely on the defocus are typically calibrated to the actual distribution of the defocus. The systems are therefore sensitive to changes in defocus distribution. In addition, the current wing mounted system relies on the accurate summation from four independent apertures. The defocus distribution in this system is also sensitive to any shift in alignment between the apertures requiring the wings to act as an optical bench.

The sensitivity to optical defocus is proportional to the number of pixels. A greater number of pixels increases the inherent angular resolution and therefore reduces the subpixel measurement accuracy reducing sensitivity to optical variations. However, adding additional pixels to a 2-d array causes the processing to increase as the square of the number of pixels in a single dimension while a system of 2 one-dimensional arrays causes the number of pixels to grow proportionally. For instance, an existant system samples horizontally and vertically with three pixels across for a total of 9 pixels while a system using 2 1-d arrays will only equivalently require 6 pixels. Increasing the system sampling to 5 pixels, the 2-d array requires 25 pixels while using 2 1-d arrays uses only 10 pixels. The low cost in additional pixels allows the 1-d system to significantly reduce sensitivity to optical variation for much lower cost than the 2-d array.

A greater number of pixels also reduces sensitivity to signal to noise. Generally, there is a relationship between signal to noise and reported sub-pixel location in units of pixels. The resultant error in angle is determined by the IFOV of the pixel multiplied by the variation in units of pixels. Using more pixels to cover a given field of view reduces the IFOV and therefore reduces the required signal for a desired angular accuracy. The 1-d array allows greater flexibility in pixel count allowing reduction in required signal received.

Processing for subpixel location typically involves a center of mass computation commonly called a centroid. The accuracy of the centroid typically requires additional processing to correct errors that are dependent on the shape of the blur on the array. This correction can be implemented in a two-dimensional lookup table. The centroid itself is computationally simple. The known systems, in contrast to the embodiments of the present invention, use an iterative computation to determine the angle to target based on relative amplitude of sensor pixel values. This is a computationally intense operation requiring a dedicated processor. This choice in computation allows subpixel locations to be determined closer to the edge of the array than the conventional centroiding approach, This allows expansion of usable field of view without the additional cost of a greater number of pixels.

Determination of angle to target, by one embodiment of the present invention, will require the combined information from two of the four sensors, dependent on detected quadrant for the target. A single sensors measurement of angle position will have an error that is dependent on the distance of the target off the axis coincident with the sense axis for that array. The distance off the axis is determined by the orthogonal sensor, though its error is also dependent on the distance off of its axis. The errors in the horizontal and vertical measurement of target are predictable and monotonic allowing correction through a two dimensional lookup table. Such a lookup table takes the horizontal and vertical measurements as input and generates a corrected horizontal and vertical measurement.

The optical system for a 1-d sensor in one embodiment is long and narrow for mounting in the leading edge of a wing. Such a system would benefit from an asymmetric prescription to maximize resolution in the long axis and provide a wide field of view in the narrow axis. The sharper optical curvature required for wide angle viewing coincides nicely with the shape required for aerodynamics. The increase in aperture area required to recover loss in detector sensitivity with the PIN diodes is accommodated in the long dimension along the wing. Using an existing system as a basis, the field of regard for the system would be 0 to 14 degrees in the horizontal and +/−14 degrees in the vertical. The vertical field of regard requirement actually varies along the length of the array as the true field of view requirement is a 14 degree radius. The field of regard can actually be sized based on the particular system requirements.

Figure 5A:
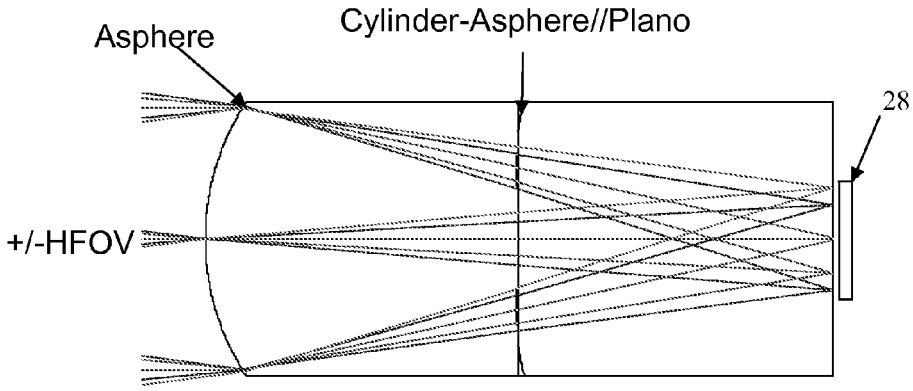
FIG. 5A is a top view illustrating the imaging axis configured according to one embodiment of the present invention.
Figure 5B:
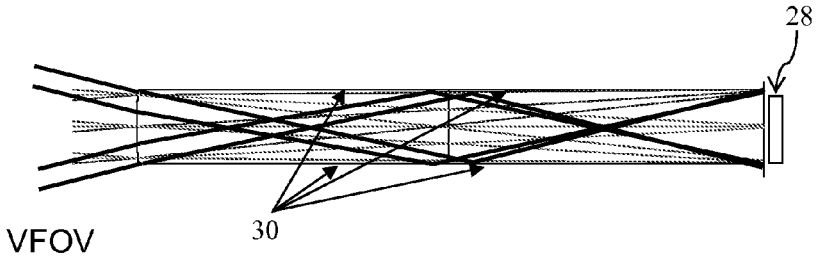
FIG. 5B is a side view illustrating the non-imaging axis of an optical system configured according to one embodiment of the present invention.

The optical systems configured according to one embodiment of the present invention are illustrated in FIGS. 5A through 7C are imaging in one axis and non-imaging in the orthogonal axis. The imaging axis of the optical system, Illustrated in FIG. 5A provides a blur of known size in the long dimension of the detector array 28 from a target source in the field of view such that its position along the array can be correlated with a horizontal input angle. The non-imaging axis of the optical system, illustrated in FIG. 5B, collects light from a target source any wherein the vertical field of view and distributes it in the short dimension of the detector array.

Figure 6:
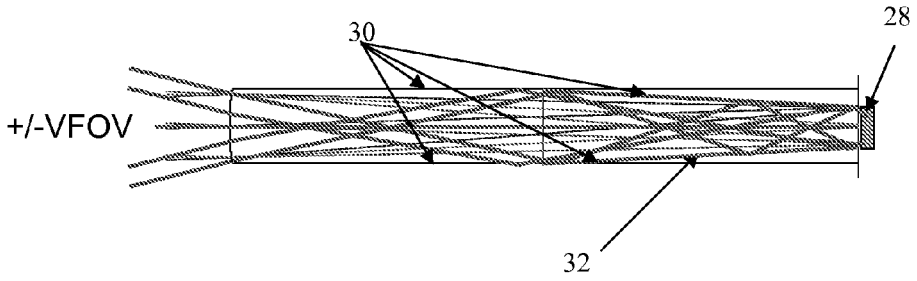
FIG. 6 is a side view illustrating a waveguide used in the non-imaging axis of an optical system configured according to one embodiment of the present invention.
Figure 7A:
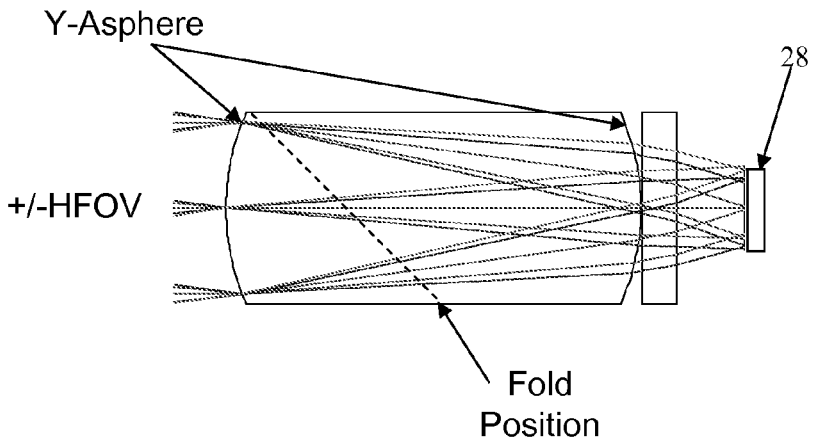
FIG. 7A is a top plan view illustrating an embodiment with cylinder lens used to reduce the size of vertical field relative to the input aperture, and the optical system folded for packaging into a form factor compatible with mounting in the leading edge of a wing.
Figure 7B:
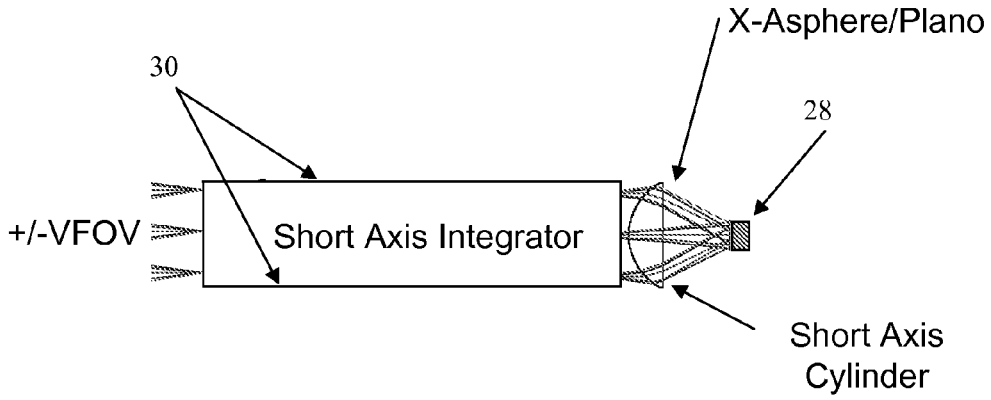
FIG. 7B is a side elevation view illustrating an embodiment with cylinder lens used to reduce the size of vertical field relative to the input aperture, and the optical system folded for packaging into a form factor compatible with mounting in the leading edge of a wing.
Figure 7C:
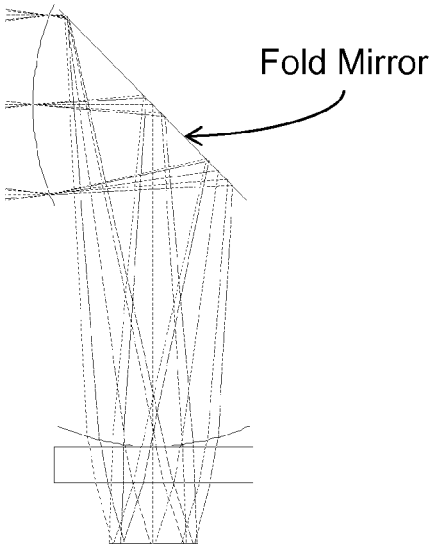
FIG. 7C is a diagrahm illustrating an embodiment with the optical system folded for packaging into a form factor compatible with mounting in the leading edge of a wing.

The narrow non-imaging axis of the optical systems is designed to act as an integrator, homogenizing the light from a source at any angle in the vertical field of view (VFOV) by a waveguide 30 comprised of total internal reflecting (TIR) surfaces, causing it to be spread over the full narrow dimension of the detector 28. The integration effect is accomplished by multiple reflections in the waveguide 30 over its narrow dimension as light passes from the input to the output side of the optical system as illustrated in FIG. 6. Adding a taper 32 to the waveguide from input to output allows the detector's vertical height to be narrower than the input aperture, In another embodiment in FIGS. 7A-7C show a cylinder lens used to reduce the size of the integrated vertical field relative to the input aperture, and in FIG. 7C, a method for the optical system to be folded for packaging into a form factor compatible with mounting in the leading edge of a wing.

An asymmetric lens system will require the wing sweep that is almost normal to the body. The ideal wing sweep of one embodiment of the present invention would be approximately 7 degrees, the 60 degree wing sweep of known systems will likely not be acceptable. Consideration must be made in the aerodynamic design in order to accommodate the reduced sweep.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A system for semi-active laser designation, the system comprising:

A guidance and control system having a plurality of wings disposed at an aerodynamically advantageous angle;

A plurality of linear sensor arrays configured to measure location of a target, each said sensor array being disposed on a wing of said plurality of wings each said linear sensor arrays comprising a linear array of sensor elements coupled to an asymmetrical lens, each said sensor array being configured to provide a 1 dimensional measurement of a target location orthogonal to a body to which said plurality of wings is affixed; and Each said linear sensor array providing independent angle data to said guidance and control system as to said location of said target and target location is determined two sensors from said plurality of linear sensor arrays.

2. The system of claim 1 wherein said linear sensor array comprises a plurality of InGaAs Pin Diodes.

3. The system of claim 1 wherein said linear sensor array has a sensitivity lower than an avalanche photodiode.

4. The system of claim 1 wherein said linear sensor array has a lens having an asymmetrical prescription.

5. The system of claim 1, said system having a horizontal field of regard of between 0 and 14 degrees.

6. The system of claim 1, said system having a vertical field of regard of ±14 degrees.

7. The system of claim 1, wherein said linear array comprises at least 5 pixels.

8. The system according to claim 7 wherein three of said pixels cover a 14 degree field of regard.

9. The system of claim 1, said system having an angle measurement noise of not greater than 0.28 degrees, root mean squared.

10. The system of claim 1 said aerodynamically advantageous angle being an angle of about approximately 7 degrees.

11. The system of claim 1 wherein said wing is disposed about approximately normal to the body of said system.

12. The system of claim 1 further comprising an asymmetric lens.

13. An method for the determination of angle to target of semi-active laser detection system, said method comprising:

Locating a target with two orthogonal linear sensor arrays of a plurality of linear
sensor arrays said two linear sensor arrays providing independent angle position information of a target;

Identifying a quadrant in which said target is disposed;

Obtaining measurements of angular position of the target with respect to individual sensors within said two linear sensor arrays;

Using a two dimensional lookup table relating sensed azimuth-elevation to
true azimuth elevation.

14. The method according to claim 13, wherein said lookup table contains true azimuth data calculated from the dependency of sensed azimuth data error on distance of the target from an axis coincident with the sense axis for an array.

15. An apparatus for the detection of a target, said apparatus comprising:

A plurality of linear InGaAs sensor arrays;

said linear InGaAs arrays being configured with asymmetric lenses;

Said linear InGaAs arrays each having at least 5 pixels;

said linear InGaAs arrays being configured to provide a horizontal field of regard of 0 to 14 degrees; and angular location of said target is provided by comparison of measured angles from at least two of said InGaAs sensor arrays, said at least two of said InGaAs sensor arrays having orientations orthogonal to each other and a two dimensional lookup table relating sensed azimuth elevation and true azimuth elevation.

16. The system according to claim 1 further comprising an optical system having both imaging and non-imaging axes.

17. The system according to claim 16 wherein said non-imaging axis comprises a waveguide.

18. The system according to claim 17 wherein said waveguide is tapered.

19. The system according to claim 16 wherein said non-imaging axis comprises at least one waveguide selected from the group of waveguides consisting of non-tapered waveguides, tapered waveguides, folded waveguides, and combinations thereof.

* * * * *